US006376930B1

(12) United States Patent
Nagao et al.

(10) Patent No.: US 6,376,930 B1
(45) Date of Patent: Apr. 23, 2002

(54) PORTABLE TRANSMITTER FOR VEHICLE KEY SYSTEM

(75) Inventors: Koji Nagao; Masaru Fuku; Keiichi Enoki; Hirofumi Tatsukawa; Hisashi Ishikura; Toru Morita; Fumitaka Satou, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/661,548

(22) Filed: Sep. 14, 2000

(30) Foreign Application Priority Data

Mar. 28, 2000 (JP) ..... 2000-088937

(51) Int. Cl.[7] ..... E05B 49/00
(52) U.S. Cl. ..... 307/10.2; 340/426; 455/411
(58) Field of Search ..... 307/10.1–10.6; 713/186; 340/5.52, 5.53, 426; 455/411

(56) References Cited

U.S. PATENT DOCUMENTS 5,131,038 A * 7/1992 Puhl et al. ..... 380/23
5,874,785 A * 2/1999 Liu ..... 307/10.5
5,933,090 A * 8/1999 Christenson ..... 340/825.69
6,041,410 A * 3/2000 Hsu et al. ..... 713/186
6,088,585 A * 7/2000 Schmitt et al. ..... 455/411
6,100,811 A * 8/2000 Hsu et al. ..... 340/825.31
6,140,939 A * 10/2000 Flick ..... 340/825.69
6,141,436 A * 10/2000 Srey et al. ..... 382/124
6,144,293 A * 11/2000 Plaschko et al. ..... 340/426
6,182,221 B1 * 1/2001 Hsu et al. ..... 713/186

FOREIGN PATENT DOCUMENTS

JP 11-93478 4/1999 ..... E05B/49/00

* cited by examiner

*Primary Examiner*—Josie Ballato
(74) *Attorney, Agent, or Firm*—Sughrue Mion, PLLC

(57) ABSTRACT

A portable transmitter of vehicle key system comprising a fingerprint detecting portion for detecting the user's fingerprint, a sending component for sending the fingerprint data from this fingerprint detecting portion, and a sender switch for triggering the transmission of fingerprint data from this sending component, this sender switch and the fingerprint detecting portion being disposed integrally, whereby the sender switch is activated in accordance with the user operating the fingerprint detecting portion.

18 Claims, 8 Drawing Sheets

PORTABLE TRANSMITTER FOR VEHICLE KEY SYSTEM

BACKGROUND OF THE INVENTION

1. Field of the Invention

The present invention relates to a key system for providing high security by collating the user's fingerprint with the registered data, and more particularly to a transmitter for transmitting the fingerprint data.

2. Description of the Related Art

Conventionally, a keyless entry system using fingerprint data has been well known, as described in JP-A-11-93478, for example. Such a conventional system will be described below with reference to the drawings. FIG. 8 is a block diagram of the conventional keyless entry system, wherein reference numeral 1 denotes a keyless transmitter, and reference numeral 3 denotes a keyless receiver. This keyless transmitter 1 is usually carried by the user, and comprises a fingerprint sensor 5 for taking in the user's fingerprint data, a sending component 17, and an antenna 19.

The keyless receiver 3 comprises an antenna 7 for receiving a signal from the keyless transmitter, and a receiving component 21, wherein the feature points of the fingerprint are extracted from the received data by a feature point data extracting component 23. On the other hand, the feature point data of the user's fingerprint is extracted from the data which is transmitted from a central office 37 and received at an antenna 33 via a telephone set 31, and the user's data is stored in a feature point data storing component 29. When in actual use, the keyless receiver 3 receives a signal from the keyless transmitter 1, and the feature point data extracted by the feature point data extracting component 23 and the feature point data of the user which is preregistered and stored in the feature point data storing component 29 are collated by a collating component 25, so that a matched signal is transmitted to a control device 9 if both data are matched.

The control device 9 receives the matched signal from the collating component 25, and transmits the release information for releasing the vehicle door to a door lock driving unit 41, so that the vehicle door can be released for the driver to get into the vehicle.

In such conventional system, each unit of antitheft control, door mirror, room mirror, sheet position, audio, and navigation, besides the door lock, can be automatically set to the user personal settings registered in accordance with the registered personal information.

The present applicant has proposed a key system which transmits various kinds of command signals including a door lock for locking the vehicle door, a door unlock for releasing the lock of the vehicle door, a trunk open for opening the trunk lid of the vehicle, an engine start for starting the engine, and an engine stop for stopping the engine, at the same time with the user's fingerprint data, from a transmitter which is carried by the user, extracts the feature point data from the fingerprint data in a signal which is received by a receiver mounted on the vehicle, collates it with the preregistered data, and if both are matched, performs the operation in accordance with a command signal in the received signal. Such key system has the same basic configuration as the previously described system, except that an engine start/stop control unit 55 and a trunk lid open unit 57 are connected to the control device 9.

In the conventional key entry system as above described, when the user's finger touches the fingerprint sensor 5, the fingerprint data is transmitted from the keyless transmitter 1 to the surrounding space, but because it is not distinguishable whether the thing which has made contact with the fingerprint sensor 5 is the user's finger or not, the transmission also occurs when the thing other than the user's finger comes into contact with it.

In order to prevent this, a sender switch maybe provided, aside from the fingerprint sensor 5, in which when in use, the user touches the fingerprint sensor 5, and at the same time or thereafter, operates the sender switch to transmit the fingerprint data to the surrounding space.

In the key system which was proposed by the present applicant, the user had to select a command signal for transmission, depending on which operation should be performed among various operations, in order to issue various kinds of command signals including the door lock, the door unlock, the trunk open, the engine start, and the engine stop, as above described, and therefore the functional switches corresponding to various functions were required.

As above described, in the conventional keyless entry system or key system, the sender switch 101 or a plurality of function switches, other than the fingerprint sensor, were required to provide on the side of the keyless transmitter, as shown in FIGS. 9A and 9B, thereby resulting in a problem that the keyless transmitter is increased in size and is inconvenient for the user to carry it.

SUMMARY OF THE INVENTION

This invention has been achieved to solve the above problems, and it is an object of the invention to provide a keyless transmitter which allows the user to send the fingerprint data only when in actual use, or allows the user to select a necessary command signal for transmission, wherein the keyless transmitter is prevented from increasing in size and appropriate for the user to carry it.

A keyless system according to this invention comprises a fingerprint detecting portion for detecting the user's fingerprint, a sending component for sending the fingerprint data from this fingerprint detecting portion, and a sender switch for triggering the transmission of fingerprint data from this sending component, wherein this sender switch and the fingerprint detecting portion are disposed integrally, and the sender switch is activated in accordance with the user operating the fingerprint detecting portion.

Also, the sender switch is activated by depressing this fingerprint detecting portion.

Also, the sender switch is activated by sliding the fingerprint detecting portion.

Also, an operation stick is provided, the fingerprint detecting portion being disposed on the top of this operation stick, wherein the sender switch is activated by tilting the operation stick in a predetermined direction.

A key system according to this invention comprises a fingerprint detecting portion for detecting the user's fingerprint, a sending component for sending the fingerprint data from this fingerprint detecting portion and selectively sending a multiplicity of actuating command signals for determining the operation of a control device provided in a vehicle, and a sender switch for triggering the transmission of fingerprint data from this sending component, wherein this sender switch and the fingerprint detecting portion are integrally disposed, and the sender switch is activated in accordance with the user operating the fingerprint detecting portion.

Also, the sender switch is activated by depressing the fingerprint detecting portion.

Also, the kind of command signal transmitted from the sending component is changed in accordance with the number of depressing the fingerprint detecting portion.

Also, the kind of command signal transmitted from the sending component is changed in accordance with the depression time of the fingerprint detecting portion.

Also, the kind of command signal transmitted from the sending component is changed in accordance with the depression depth of the fingerprint detecting portion.

Also, the sender switch is activated by sliding the fingerprint detecting portion.

Also the kind of command signal transmitted from the sending component is changed in accordance with the amount of sliding the fingerprint detecting portion.

Also, the kind of command signal transmitted from the sending component is changed in accordance with the direction of sliding the fingerprint detecting portion.

Also, an operation stick is provided, the fingerprint detecting portion being disposed on the top of this operation stick, wherein the sender switch is activated by tilting the operation stick in a predetermined direction.

Also, the kind of command signal transmitted from the sending component is changed in accordance with the direction of tilting the operation stick.

Further, the kind of command signal transmitted from the sending component is changed in accordance with the angle of tilting the operation stick.

Further, the command signals include at least a lock command signal for locking the vehicle door and an engine stop command signal for stopping the vehicle engine, wherein the lock command signal and the engine stop command signal are transmitted by the same operation.

DETAILED DESCRIPTION OF THE PRESENT INVENTION

The present invention will be described in detail for each embodiment with reference to the accompanying drawings.

Embodiment 1

Figure 8:
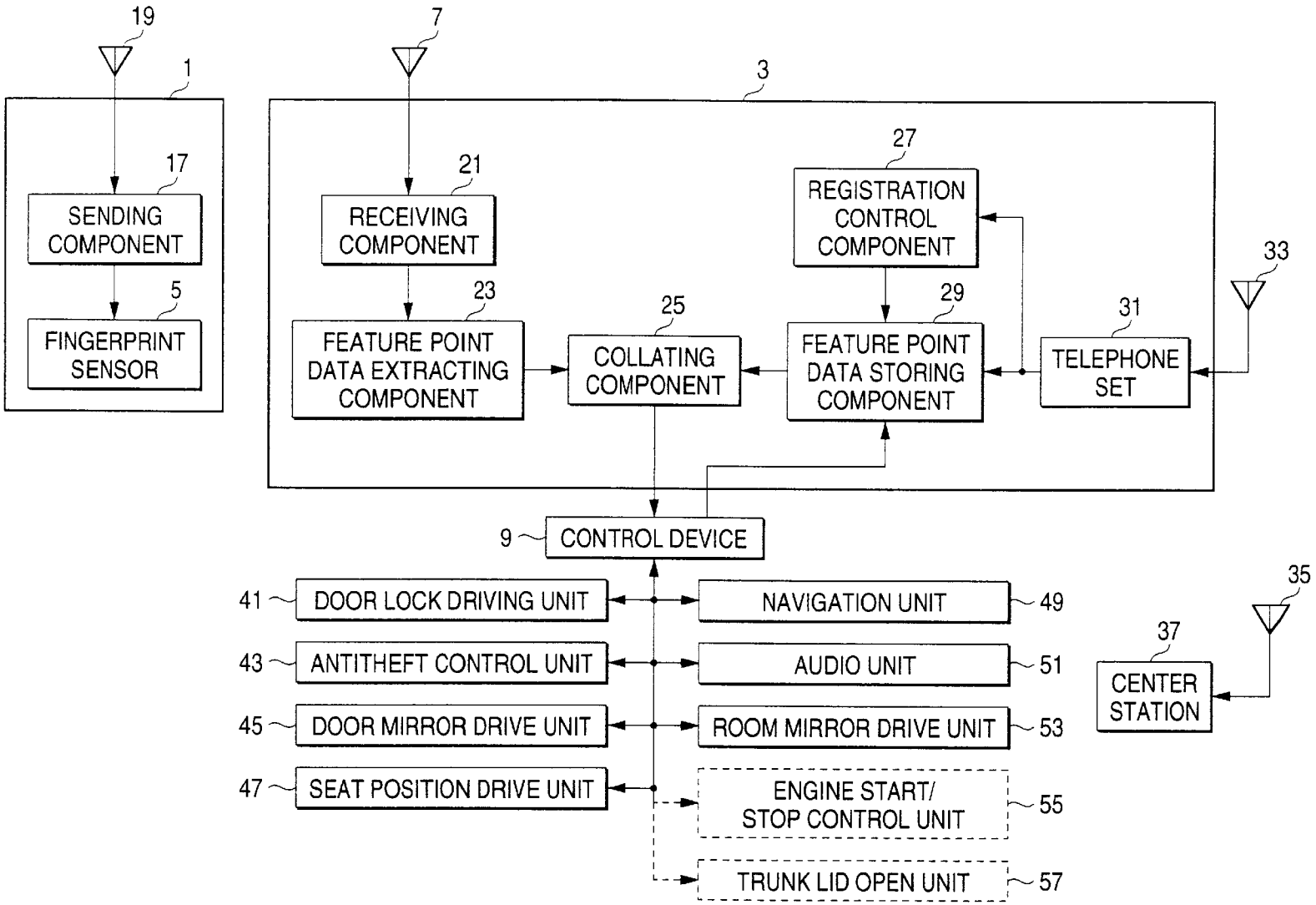
FIG. 8 is a block diagram showing the basic configuration of the conventional keyless entry system.
Figure 9A:
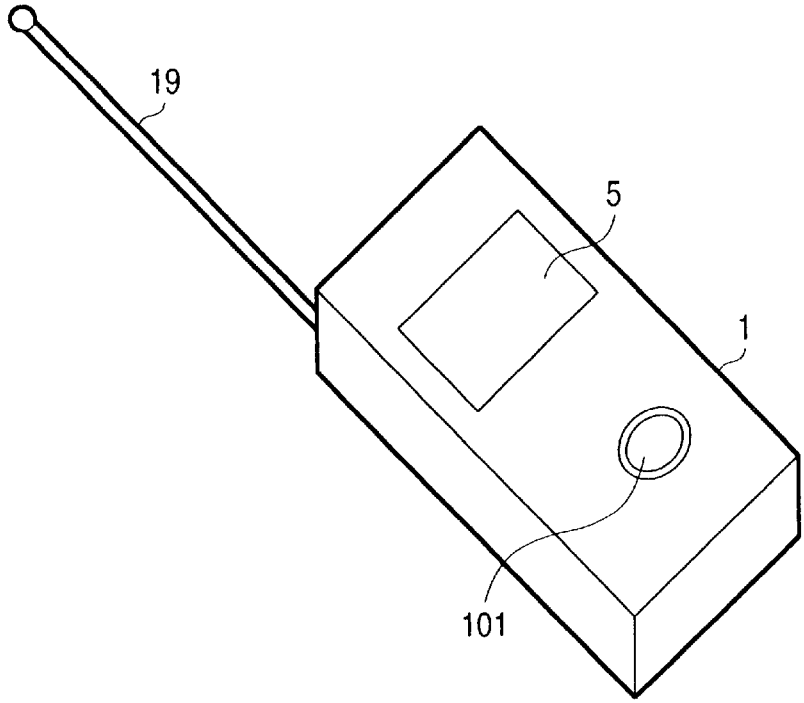
FIGS. 9A and 9B are views illustrating a keyless portable telephone in the conventional keyless entry system.
Figure 9B:
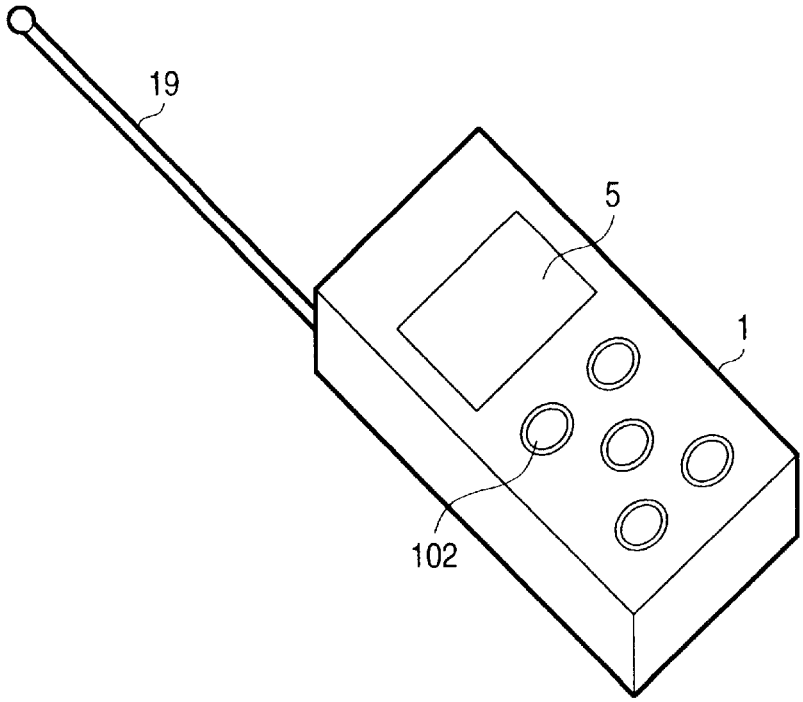

One embodiment of this invention will be described below with reference to the drawings. A basic configuration of a key system according to this invention is substantially the same as the conventional keyless entry system as shown in FIG. 8, and is not described in detail. However, the functional units for performing various functions which are connected to a control device 9 include an engine start/stop control unit 55 for starting or stopping the engine from the outside of the vehicle, and a trunk lid open unit 57 for opening the trunk lid.

Figure 1:
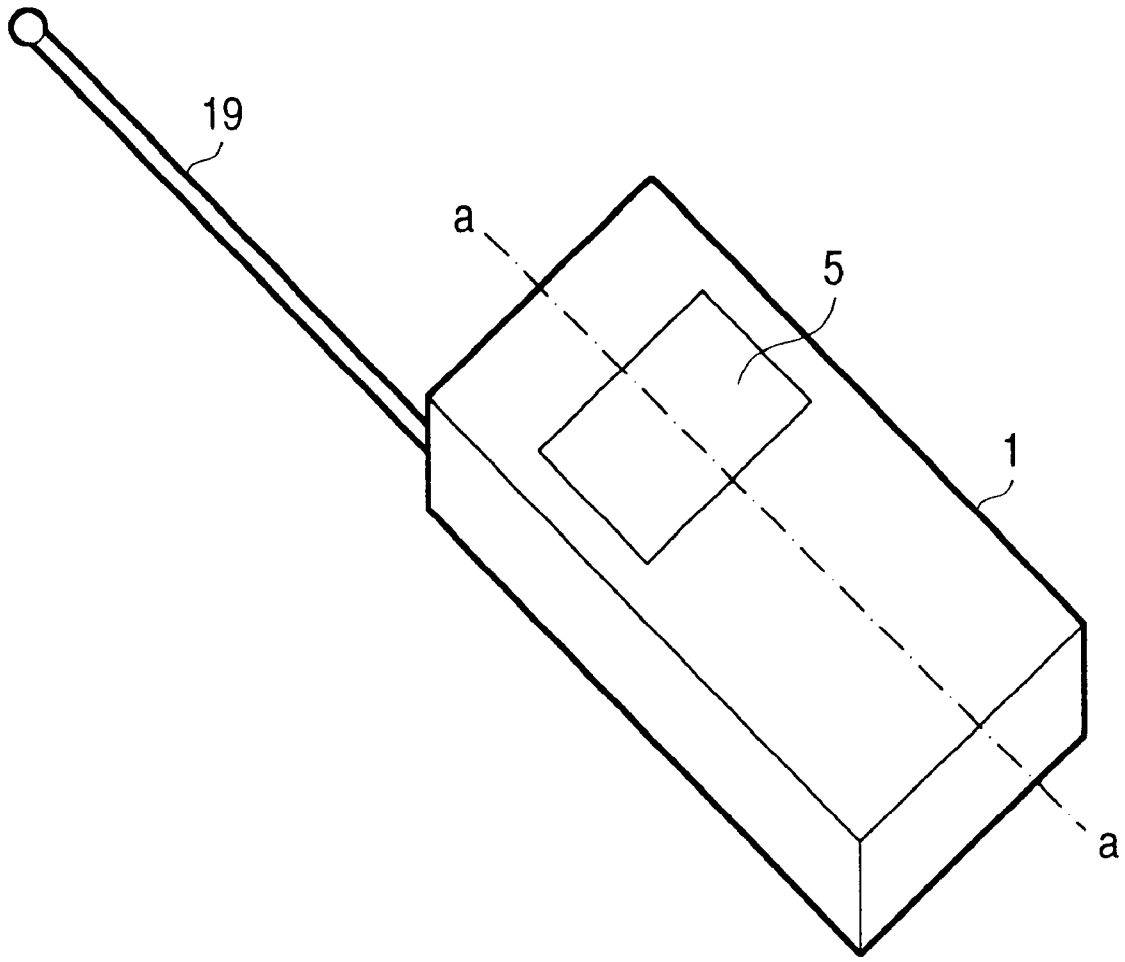
FIG. 1 is a view illustrating a key transmitter of one embodiment according to this invention.

FIG. 1 shows one embodiment of a keyless transmitter 1 according to this invention. The keyless transmitter 1 has a fingerprint sensor 5 and an antenna 19, as above described, and contains a sending component 17 for sending the fingerprint data detected by this fingerprint sensor 5. This antenna 19 may be a so-called rod antenna, as shown in FIG. 1, or may be contained within the keyless transmitter 1.

Figure 2A:
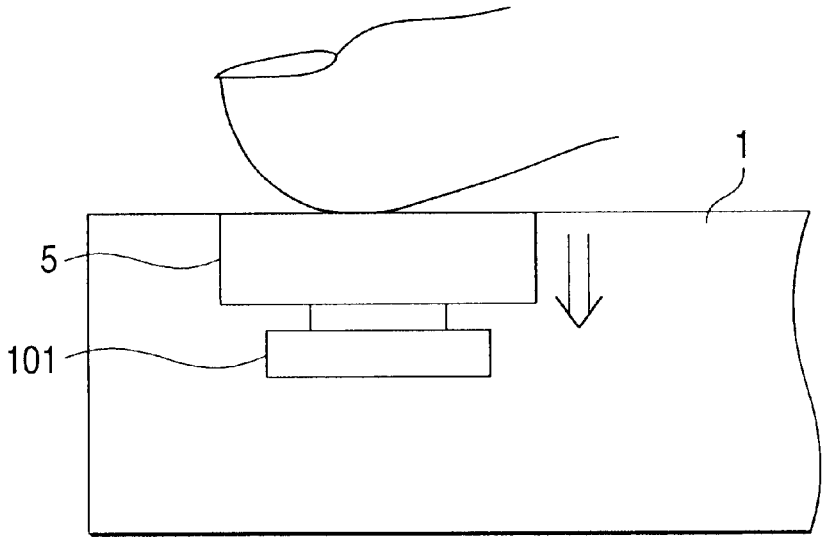
FIGS. 2A and 2B are cross-sectional views in essence illustrating the key transmitter of one embodiment according to this invention.
Figure 2B:
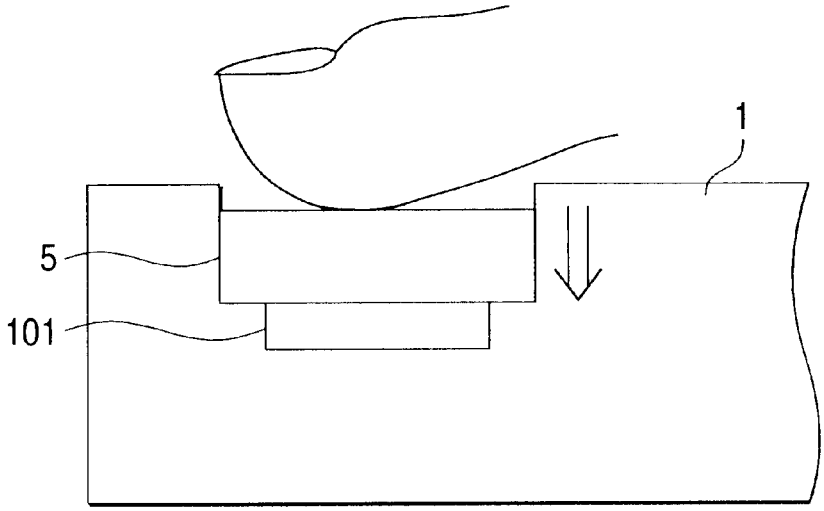

The fingerprint sensor 5 as shown in FIG. 1 has a sender switch 101 integrally, wherein depressing the fingerprint sensor 5 as shown in FIGS. 2A and 2B (a—a cross-sectional view in FIG. 1) can turn on the sender switch 101 provided on the bottom of the fingerprint sensor 5, and the sending component 17 sends the fingerprint data detected when the sender switch 101 is turned on.

In one embodiment of this invention as above described, when the user wants to use the vehicle, the user places one's finger on the fingerprint sensor 5 and depresses the fingerprint sensor 5 to turn on the sender switch 101, so that the fingerprint data can be transmitted in accordance with the user's will, wherein when any thing other than the finger makes contact with the fingerprint sensor 5, no data is transmitted, and because the fingerprint sensor 5 and the sender switch are integrally provided, the keyless portable transmitter 1 can be reduced in size to enhance the portability.

Embodiment 2

While the fingerprint data is transmitted by turning on the sender switch 101 in one embodiment of this invention as above described, it can be understood that the kind of command signal to be transmitted with the fingerprint data may be determined in accordance with the number of depressing the fingerprint sensor 5 to turn on the sender switch 101, to operate various functions.

For example, an embodiment 2 can be configured to send a door lock command signal by depressing once, an engine start command signal by depressing twice, an open command signal of trunk lid by depressing three times, a door unlock command signal by depressing four times, and an engine stop command signal by depressing five times.

With such a configuration, various kinds of command signals can be transmitted by manipulating one sender switch 101, so that the keyless transmitter can be reduced in size while the keyless system has a variety of functions.

While in the embodiment 2 of the invention as above described, the kind of command signal for transmission is determined in accordance with the number of turning on the sender switch 101, it is needless to say that the kind of command signal for transmission may be further determined in accordance with the time of depression, or the stroke (depth) of depression, for example, with the same effect.

Figure 3:
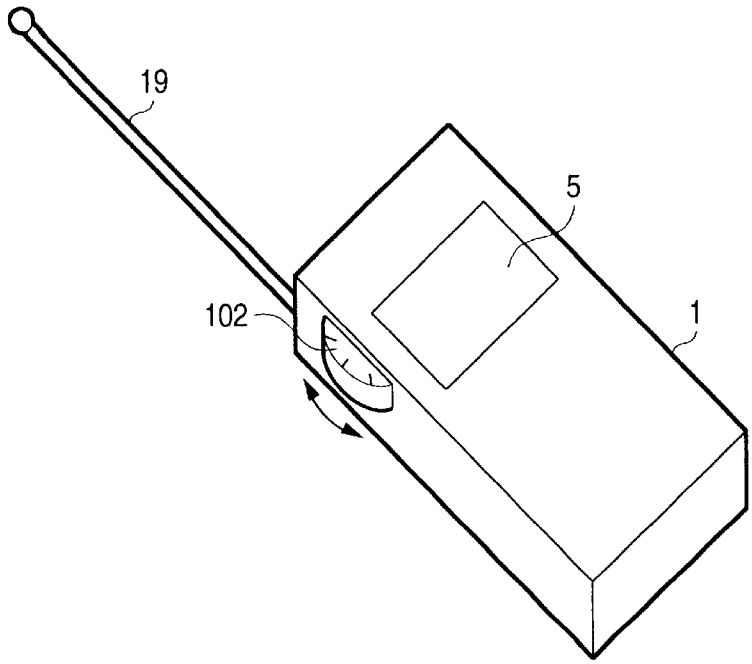
FIG. 3 is a view illustrating a key transmitter of another embodiment according to this invention.

It will be appreciated that the keyless transmitter 1 comprises a rotational drum 105, as shown in FIG. 3, the kind of command signal to be transmitted is determined in accordance with the position of rotation of the rotational drum 105, and the transmission is started by depressing the fingerprint sensor 5 to turn on the sender switch 101.

Embodiment 3

Figure 4A:
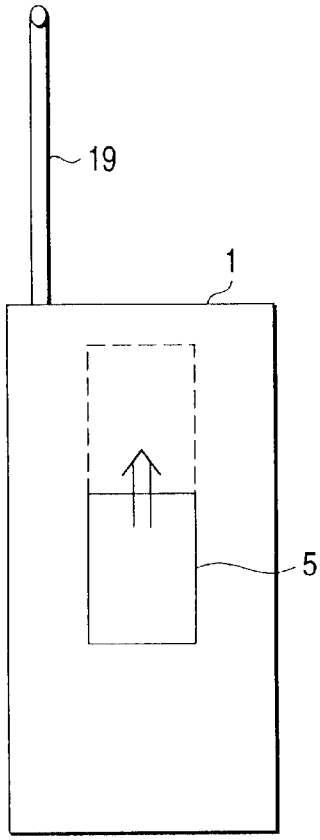
FIGS. 4A and 4B are views illustrating a key transmitter of another embodiment according to this invention.
Figure 4B:
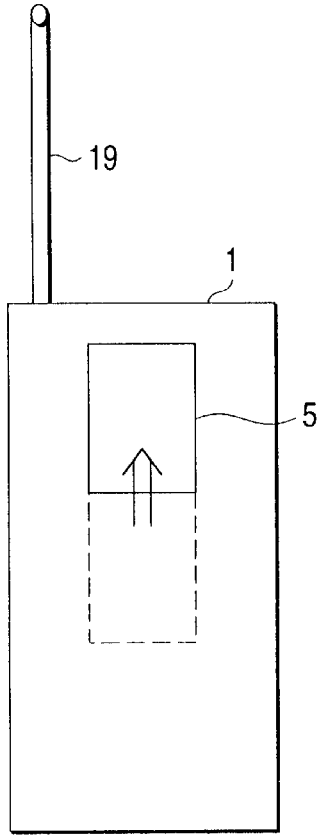

An embodiment 3 will be described below. FIGS. 4A and 4B show a keyless portable transmitter 1 according to the embodiment 3 of this invention, wherein the fingerprint sensor 5 is configured to slide upward in the figure as indicated by the arrow.

The use condition of the keyless transmitter 1 as thus configured will be described below. Firstly, the user places one's finger on the fingerprint sensor 5 of the keyless transmitter 1. Thereafter, the user slides the fingerprint sensor 5 upward in the figure to turn on the sender switch 101, so that the sending component 17 can send the fingerprint data.

In the embodiment 3 as above described, the user performs the operation of sliding the fingerprint sensor 5 to send the fingerprint data, whereby the accidental transmission against the user's will can be efficiently avoided, and the keyless transmitter can be reduced in size to enhance the portability.

Embodiment 4

Figure 5:
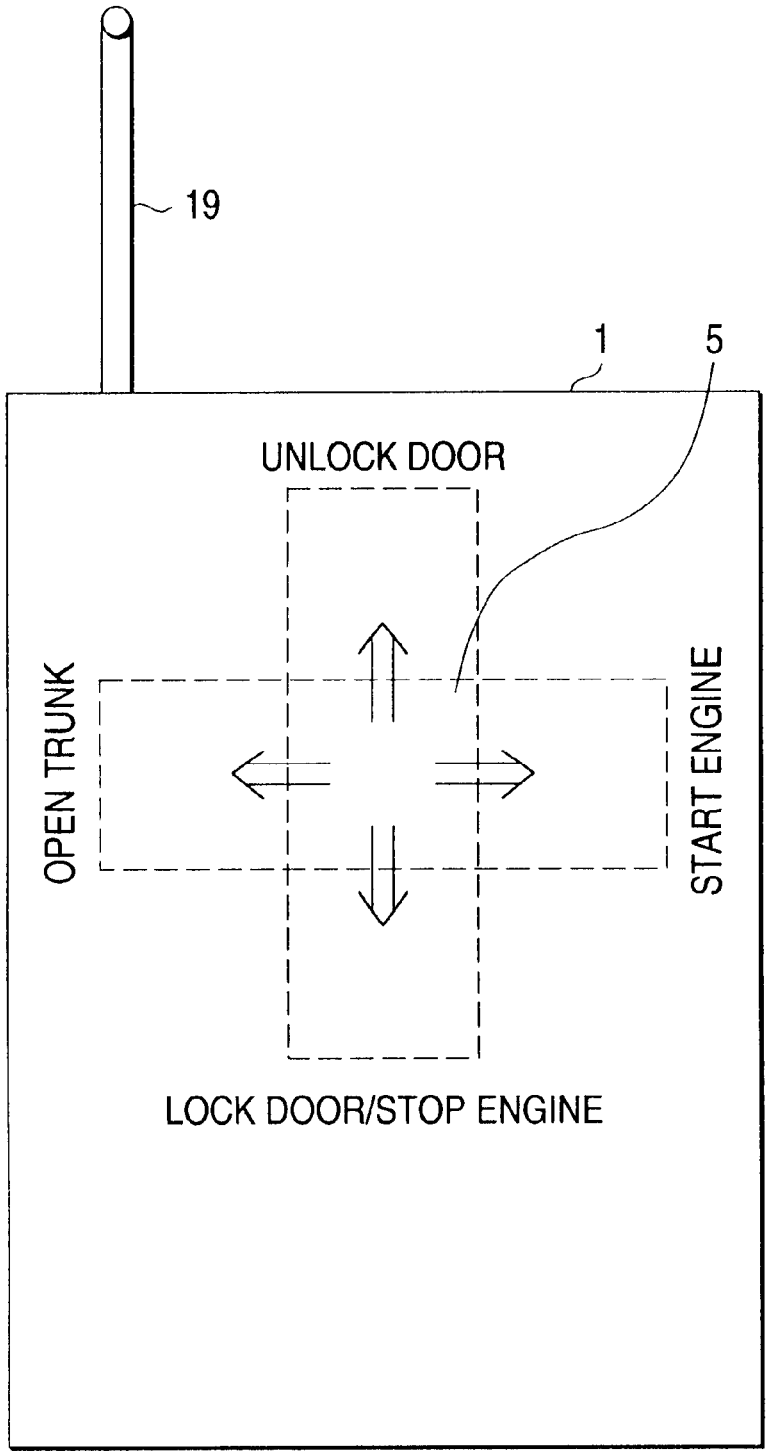
FIG. 5 is a view illustrating a key transmitter of another embodiment according to this invention.

While the fingerprint data is transmitted by sliding the fingerprint sensor 5 upward in FIGS. 4A and 4B in the embodiment 3 as above described, it can be understood that the kind of command signal for transmission may be determined in accordance with any of the four sliding directions, up, down, left or right, as indicated by the arrow in FIG. 5. For example, the command signal for transmission can be a door unlock by sliding up, an engine start by sliding right, a door lock and engine stop by sliding down, or a trunk open by sliding left.

With such a configuration, each command signal can be transmitted by a simple operation, and the keyless transmitter can be reduced in size to enhance the portability.

Herein, there are four sliding directions by integrating the door lock and the engine stop for ending the use of the vehicle, while five kinds of command signals may be provided, whereby the keyless transmitter can be made smaller than when the five sliding directions are provided.

Figure 6A:
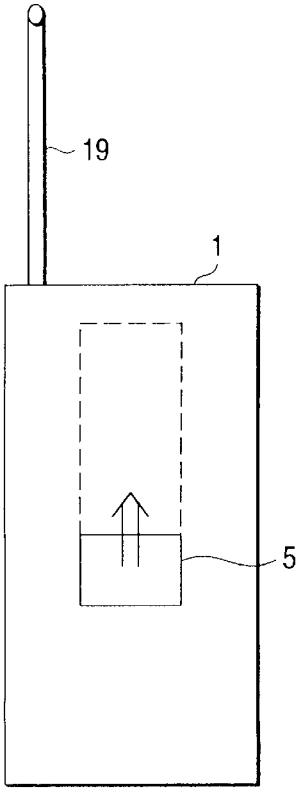
FIGS. 6A to 6C are views illustrating a key transmitter of another embodiment according to this invention.
Figure 6B:
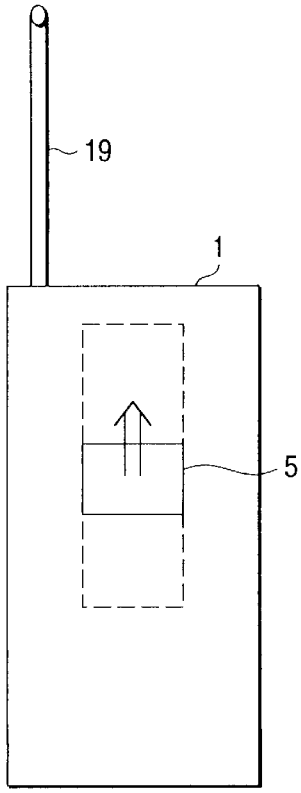
Figure 6C:
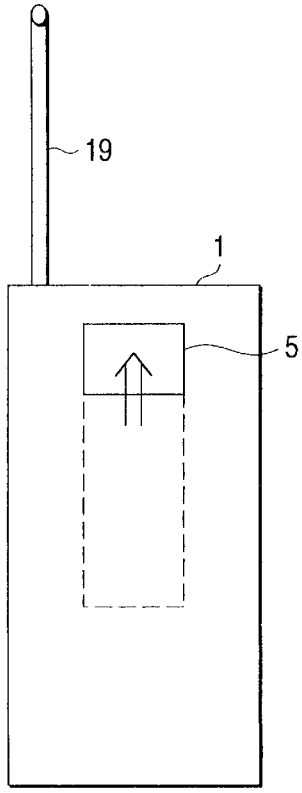

While the kind of command signal is determined by the direction of sliding in the embodiment 4 as above described, it can be understood that if the sliding is unidirectional, as shown in FIGS. 6A to 6C, the kind of command signal may be determined by the amount of sliding, whereby the keyless transmitter can be reduced in size to enhance the portability, with the same effect.

Embodiment 5

Figure 7A:
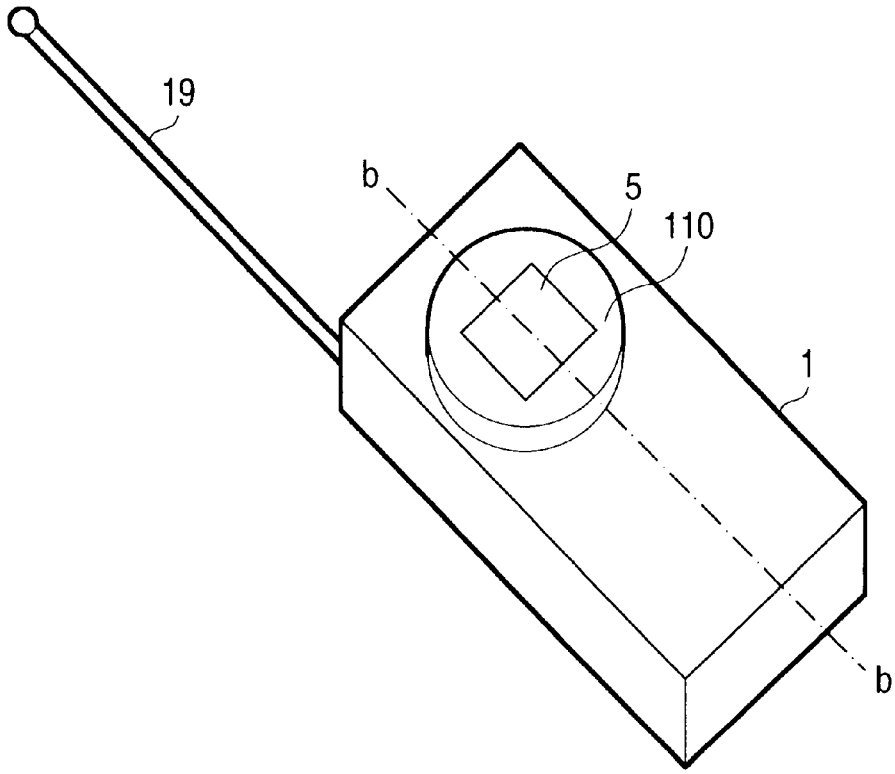
FIGS. 7A and 7B are views illustrating a key transmitter of another embodiment according to this invention.
Figure 7B:
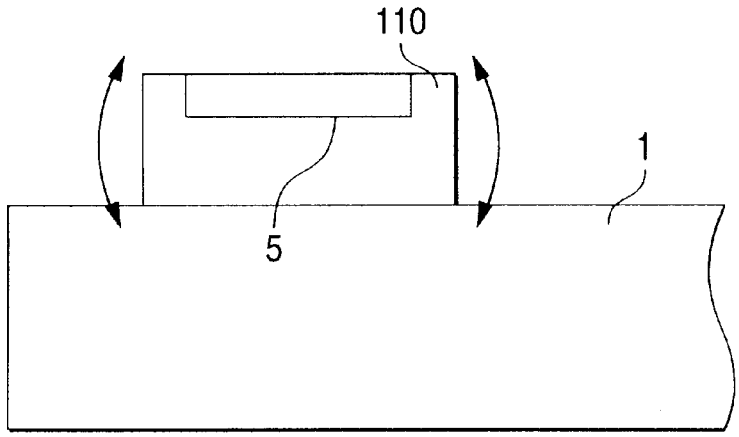

In an embodiment 5, as shown in FIGS. 7A and 7B, the fingerprint sensor 5 is provided on the top of a lever-like stick 110, and the user places one's finger on the fingerprint sensor 5 and tilts the stick 110 to the right in FIG. 7B, for example, to turn on the sender switch 101 for sending the fingerprint data, whereby there is the same effect as the above embodiments.

Also, the kind of command signal for transmission may be determined by the direction or angle of tilting the stick 110.

While the embodiments of the present invention have been described, it can be understood that various methods for determining the command signal can be additionally conceived, such as a method for determining the command signal for transmission by the degree of inclining the keyless portable transmitter 1, and may be encompassed within the scope of the invention without departing from the object of the invention.

A portable transmitter according to this invention comprises a fingerprint detecting portion for detecting the user's fingerprint, a sending component for sending the fingerprint data from this fingerprint detecting portion, and a sender switch for triggering the transmission of fingerprint data from this sending component, wherein this sender switch and the fingerprint detecting portion are integrally disposed, and the sender switch is activated in accordance with the user operating the fingerprint detecting portion, whereby there is the effect that the portable transmitter can be reduced in size to enhance the portability, while avoiding the accidental transmission against the user's will.

Also, the sender switch is activated by depressing the fingerprint detecting portion, whereby there is the effect that the portable transmitter can be reduced in size to enhance the portability, while avoiding the accidental transmission against the user's will.

Also, the sender switch is activated by sliding the fingerprint detecting portion, whereby there is the effect that the portable transmitter can be reduced in size to enhance the portability, while avoiding the accidental transmission against the user's will.

Also, an operation stick is provided, the fingerprint detecting portion being disposed on the top of the operation stick, and the sender switch is activated by tilting the operation stick in a predetermined direction, whereby there is the effect that the portable transmitter can be reduced in size to enhance the portability, while avoiding the accidental transmission against the user's will.

A key system according to this invention comprises a fingerprint detecting portion for detecting the user's fingerprint, a sending component for sending the fingerprint data from this fingerprint detecting portion and selectively sending a multiplicity of actuating command signals for determining the operation of a control device provided in a vehicle, and a sender switch for triggering the transmission of fingerprint data from this sending component, wherein this sender switch and the fingerprint detecting portion are integrally disposed, and the sender switch is activated in accordance with the user operating the fingerprint detecting portion, whereby there is the remarkable effect that the portable transmitter for selectively transmitting a multiplicity of command signals to the control device provided in the vehicle can be reduced in size to enhance the portability, while avoiding the accidental transmission against the user's will.

Also, the sender switch is activated by depressing the fingerprint detecting portion, whereby there is the effect that the portable transmitter can be reduced in size to enhance the portability, while avoiding the accidental transmission against the user's will.

Also, the kind of command signal transmitted from the sending component is changed in accordance with the number of depressing the fingerprint detecting portion, whereby there is the remarkable effect that the command signal can be selected with a simple operation and the portable transmitter can be reduced in size to enhance the portability, while avoiding the accidental transmission against the user's will.

Also, the kind of command signal transmitted from the sending component is changed in accordance with the depression time of the fingerprint detecting portion, whereby there is the remarkable effect that the command signal can be selected with a simple operation and the portable transmitter can be reduced in size to enhance the portability, while avoiding the accidental transmission against the user's will.

Also, the kind of command signal transmitted from the sending component is changed in accordance with the depression depth of the fingerprint detecting portion, whereby there is the remarkable effect that the command signal can be selected with a simple operation and the portable transmitter can be reduced in size to enhance the portability, while avoiding the accidental transmission against the user's will.

Also, the sender switch is activated by sliding the fingerprint detecting portion, whereby there is the remarkable effect that the portable transmitter can be reduced in size to enhance the portability, while avoiding the accidental transmission against the user's will.

Also, the kind of command signal transmitted from the sending component is changed in accordance with the amount of sliding the fingerprint detecting portion, whereby there is the remarkable effect that the command signal can be selected with a simple operation, and the portable transmitter can be reduced in size to enhance the portability, while avoiding the accidental transmission against the user's will.

Also, the kind of command signal transmitted from the sending component is changed in accordance with the direction of sliding the fingerprint detecting portion, whereby there is the remarkable effect that the command signal can be selected with a simple operation and the portable transmitter can be reduced in size to enhance the portability, while avoiding the accidental transmission against the user's will.

Also, an operation stick is provided, the fingerprint detecting portion being disposed on the top of the operation stick, wherein the sender switch is activated by tilting the operation stick in a predetermined direction.

Also, the kind of command signal transmitted from the sending component is changed in accordance with the direction of tilting the operation stick, whereby there is the remarkable effect that the command signal can be selected with a simple operation and the portable transmitter can be reduced in size to enhance the portability, while avoiding the accidental transmission against the user's will.

Also, the kind of command signal transmitted from the sending component is changed in accordance with the angle of tilting the operation stick, whereby there is the remarkable effect that the command signal can be selected with a simple operation and the portable transmitter can be reduced in size to enhance the portability, while avoiding the accidental transmission against the user's will.

Further, the command signals include at least a lock command signal for locking the vehicle door and an engine stop command signal for stopping the engine of the vehicle, the lock command signal and the engine stop command signal being sent by the same operation, wherein among a plurality of command signals, the command signals for locking the vehicle door and stopping the engine operation in ending the use of the vehicle can be transmitted collectively to simplify the operation required to select the command signal, resulting in the remarkable effect that the portable transmitter can be reduced in size to enhance the portability.

What is claimed is:

1. A portable transmitter for vehicle key system comprising:

a fingerprint detecting portion for detecting the user's fingerprint;

a sending component for sending the fingerprint data from the fingerprint detecting portion and selectively sending a multiplicity of actuating command signals for determining the actuation of a control device provided in a vehicle; and a sender switch for triggering the transmission of fingerprint data and the command signals from the sending component, the sender switch being integrally disposed with the fingerprint detecting portion, wherein the sender switch is activated and the types of command signals are selected in accordance with the user operating the fingerprint detecting portion.

2. The portable transmitter for vehicle key system according to claim 1, wherein the sender switch is activated by depressing the fingerprint detecting portion.

3. The portable transmitter for vehicle key system according to claim 2, wherein the kind of command signal transmitted from the sending component is changed in accordance with the number of depressing the fingerprint detecting portion.

4. The portable transmitter for vehicle key system according to claim 3, wherein the command signals include at least a lock command signal for locking the vehicle door and an engine stop command signal for stopping the engine of the vehicle, wherein the lock command signal and the engine stop command signal are transmitted by the same operation.

5. The portable transmitter for vehicle key system according to claim 2, wherein the kind of command signal transmitted from the sending component is changed in accordance with the depression time of the fingerprint detecting portion.

6. The portable transmitter for vehicle key system according to claim 5, wherein the command signals include at least a lock command signal for locking the vehicle door and an engine stop command signal for stopping the engine of the vehicle, wherein the lock command signal and the engine stop command signal are transmitted by the same operation.

7. The portable transmitter for vehicle key system according to claim 2, wherein the kind of command signal transmitted from the sending component is changed in accordance with the depression depth of the fingerprint detecting portion.

8. The portable transmitter for vehicle key system according to claim 7, wherein the command signals include at least a lock command signal for locking the vehicle door and an engine stop command signal for stopping the engine of the vehicle, wherein the lock command signal and the engine stop command signal are transmitted by the same operation.

9. The portable transmitter for vehicle key system according to claim 1, wherein the sender switch is activated by sliding the fingerprint detecting portion.

10. The portable transmitter for vehicle key system according to claim 9, wherein the kind of command signal transmitted from the sending component is changed in accordance with the amount of sliding the fingerprint detecting portion.

11. The portable transmitter for vehicle key system according to claim 10, wherein the command signals include at least a lock command signal for locking the vehicle door and an engine stop command signal for stopping the engine of the vehicle, wherein the lock command signal and the engine stop command signal are transmitted by the same operation.

12. The portable transmitter for vehicle key system according to claim 9, wherein the kind of command signal transmitted from the sending component is changed in accordance with the direction of sliding the fingerprint detecting portion.

13. The portable transmitter for vehicle key system according to claim 12, wherein the command signals include at least a lock command signal for locking the vehicle door and an engine stop command signal for stopping the engine of the vehicle, wherein the lock command signal and the engine stop command signal are transmitted by the same operation.

14. The portable transmitter for vehicle key system according to claim 1, wherein the finger print detecting portion includes an operation stick and the sender switch is activated by tilting the operation stick in a predetermined direction.

15. The portable transmitter for vehicle key system according to claim 14, wherein the kind of command signal transmitted from the sending component is changed in accordance with the direction of tilting the operation stick.

16. The portable transmitter for vehicle key system according to claim 15, wherein the command signals include at least a lock command signal for locking the vehicle door and an engine stop command signal for stopping the engine of the vehicle, wherein the lock command signal and the engine stop command signal are transmitted by the same operation.

17. The portable transmitter for vehicle key system according to claim 14, wherein the kind of command signal transmitted from the sending component is changed in accordance with the angle of tilting the operation stick.

18. The portable transmitter for vehicle key system according to claim 17, wherein the command signals include at least a lock command signal for locking the vehicle door and an engine stop command signal for stopping the engine of the vehicle, wherein the lock command signal and the engine stop command signal are transmitted by the same operation.

* * * * *